US006818099B2

(12) United States Patent
Tienvieri et al.

(10) Patent No.: US 6,818,099 B2
(45) Date of Patent: Nov. 16, 2004

(54) RAW MATERIAL FOR PRINTING PAPER, METHOD TO PRODUCE IT AND PRINTING PAPER

(75) Inventors: Taisto Tienvieri, Valkeakoski (FI); Markku Gummerus, Tampere (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 10/165,191

(22) Filed: Jun. 7, 2002

(65) Prior Publication Data

US 2003/0006016 A1 Jan. 9, 2003

Related U.S. Application Data

(63) Continuation of application No. PCT/FI00/01054, filed on Dec. 1, 2000.

(51) Int. Cl.[7] ..... D21H 11/08; D21B 1/14; D21C 9/00; D21C 9/08

(52) U.S. Cl. ..... 162/56; 162/55; 162/20; 241/21; 241/24.1; 241/29; 241/30

(58) Field of Search ..... 162/55–56, 20, 162/28, 100; 241/21, 24, 28–30

(56) References Cited

U.S. PATENT DOCUMENTS

| | | | | | |
|---|---|---|---|---|---|
| 4,116,758 | A | * | 9/1978 | Ford et al. | 162/28 |
| 4,244,778 | A | * | 1/1981 | Lindahl et al. | 162/17 |
| 4,562,969 | A | * | 1/1986 | Lindahl | 241/21 |
| 4,718,980 | A | * | 1/1988 | Lowrie et al. | 162/78 |
| 4,776,926 | A | * | 10/1988 | Lindahl | 162/28 |
| 4,938,843 | A | * | 7/1990 | Lindhal | 162/55 |
| 4,966,651 | A | * | 10/1990 | Olson et al. | 162/28 |
| 5,145,010 | A | * | 9/1992 | Danielsson et al. | 162/26 |
| 5,394,600 | A | * | 3/1995 | Chen | 29/447 |
| 5,427,651 | A | | 6/1995 | Lindahl | |
| 5,582,352 | A | | 12/1996 | Bokstrom | |
| 5,607,546 | A | * | 3/1997 | Hoglund et al. | 162/25 |
| 5,799,798 | A | | 9/1998 | Chen | |
| 5,879,510 | A | * | 3/1999 | Hagglund et al. | 162/25 |
| 6,336,602 | B1 | * | 1/2002 | Miles | 241/28 |
| 6,361,650 | B1 | * | 3/2002 | Danielsson et al. | 162/28 |
| 6,458,245 | B1 | * | 10/2002 | Hoglund et al. | 162/149 |
| 2002/0088569 | A1 | * | 7/2002 | Bryant et al. | 162/63 |
| 2003/0006016 | A1 | * | 1/2003 | Tienvieri et al. | 162/20 |
| 2003/0015305 | A1 | * | 1/2003 | Tienvieri et al. | 162/56 |

FOREIGN PATENT DOCUMENTS

| | | |
|---|---|---|
| DE | 2714730 | 10/1977 |
| EP | 0138484 | 4/1985 |
| SE | 397851 | 11/1977 |

OTHER PUBLICATIONS

International Search Report for International application No. PCT/FI00/01054, mailed on Mar. 16, 2001.

International Search Report for International application No. PCT/FI00/01055, mailed on May 17, 2001.

Printout from Dialog(R) File 351 is provided for Finnish publication which supplies relevant patent information, and English language title and abstract.

* cited by examiner

*Primary Examiner*—José A. Fortuna
(74) *Attorney, Agent, or Firm*—Fitch, Even, Tabin & Flannery

(57) ABSTRACT

The object of the present invention is a method for making mechanical pulp, such as thermomechanical or chemi-thermomechanical stock. The mechanical pulp is utilised as a raw material for printing paper, and its freeness value is 30—70 ml CSF. According to the method, the refined stock is screened in several stages into accept and reject stock portions. The stock is screened at a consistency of not less than 10%.

39 Claims, 6 Drawing Sheets

RAW MATERIAL FOR PRINTING PAPER, METHOD TO PRODUCE IT AND PRINTING PAPER

Figure 1:
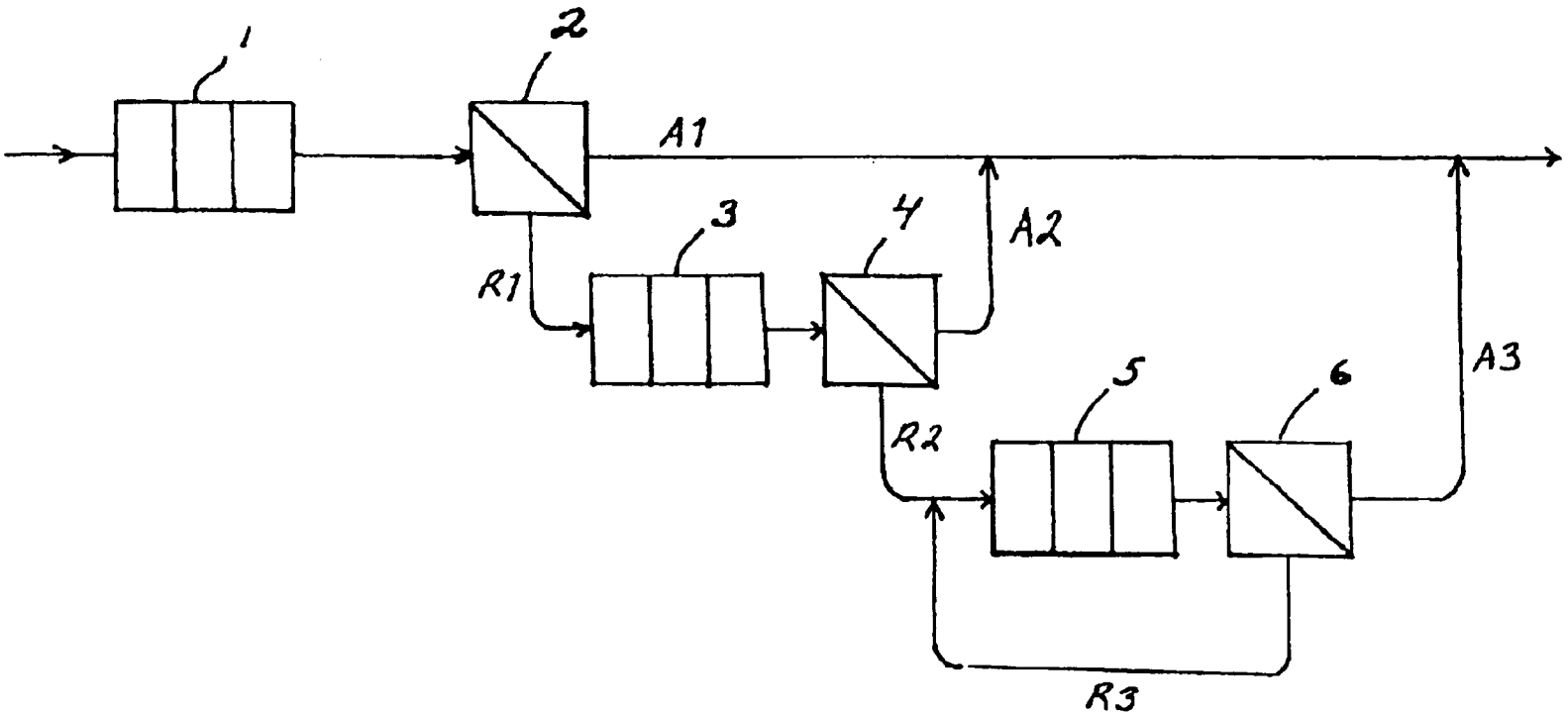

This application is a Continuation of PCT/F100/01054 filed on Dec. 1, 2000.

The present invention relates to stock, a method for preparing it, the use of the stock as a raw material for producing printing paper, especially newsprint, and a printing paper. The stock produced in accordance with the method of the present invention can be used as a raw material for producing different papers, such as SC paper (supercalendered) comprising both offset and gravure grades, coated paper having a low grammage or LWC paper (light weight coated) comprising both offset and gravure grades, and newsprint or corresponding printing papers. Newsprint also comprises other grades of paper than those used in newspapers, e.g. catalogue papers and gravure papers.

A known method for producing mechanical pulp is presented in patent publication U.S. Pat. No. 5,145,010, corresponding to international application WO 8906717 and Swedish patent publication SE 459924. The method comprises the following phases:

impregnating softwood chips with water and chemicals primary refining of the treated chips fractionating the refined softwood pulp into accept and reject stock portions, whereby the reject portion comprises 15–35% of the refined stock refining of the reject stock portion in two steps, whereby the stock consistency in the first step is approximately 20–35% and in the third step approximately 5%, and the above-mentioned stock is fractionated to form an accept stock portion and a reject stock portion. The fractionation is carried out with a screen.

A known method for producing mechanical pulp is presented in patent publication U.S. Pat. No. 4,938,843. The process involves the production of chemi-thermomechanical stock. The chips impregnated with chemicals and treated with heat are refined to a freeness value of 100–700 ml CSF, usually in a two-phase refining process and screened to form a first accept stock portion and a first reject stock portion, so that at least 30% of the stock goes into the reject stock portion. The consistency of the stock during the screening is approximately 2%. The first accept stock portion is screened for a second time, whereby a second accept stock portion and a second reject stock portion are formed. The first and the second reject stock portions are combined, creating a long-fibre fraction with a freeness value of 200–750 ml CSF, which can be used separately to produce coarse-fibred products, for example cardboard, or it can be further refined and returned to the first screening.

A known method is the method for producing stock described in the introductory part of patent claim 1 of the present application, in which method the process is begun with two-phase refining. The chips are fed into the first refiner, from which they are fed into the second refiner after the first refining is complete. After the second refiner, the freeness value of the stock is about 120 ml CSF. The consistency is typically 50% at the first refiner and 45% at the second refiner. After the first refiner, the measured average fibre length, when using spruce as the raw material, is approximately 1.7 mm, and after the second refiner the average fibre length when using the same raw material, is approximately 1.5 mm. After the second refiner there is a latency chest, in which the fibres are straightened by diluting the consistency to 1–2%. The fibres are treated in the latency chest for one hour. The fibres are conveyed to the first screen, which fractionates the stock into an accept portion and a reject portion. The freeness value of the accept stock portion is about 20 ml CSF. Water is removed from the reject stock portion to obtain a consistency of 45%. The reject stock portion, which constitutes 40–50% of the total stock, is conveyed to the third refiner, from which the reject stock diluted to a consistency of 1%, is transported on to a second screen. Again the stock is fractionated into an accept stock portion and a reject stock portion. The reject stock portion is conveyed, after the removal of water, at a consistency of 45%, to a fourth refiner and after being diluted to a consistency of 1%, on to a third screen. The reject stock portion from this screen is fed again to the fourth refiner. The stock obtained from the process has a freeness value of 30–70 ml CSF. advantageously about 50 ml CSF. The pressure used in the refiners is 350–400 kPa. The process consumes about 3.3 MWh/t of energy (using spruce as the raw material), 0.3 MWh/t of which is used for regulating the consistency so as to be suitable for every stage of the process.

In the process mentioned above, regulating the consistency to a suitable level consumes 9–10% of the total energy used in the process. In the present application, consistency refers to the amount of stock as a percentage by weight in the mixture of pulp and water. The water can be either in vapour or in liquid form.

After the refining, a latency chest, in which the fibres remain, is needed to straighten the fibres. Regulating stock consistency requires the use of suitable equipment, for example presses to press water out and pumps to pump water into the process. This means that the process is prolonged and the equipment for the process is complex. In addition, the problems of the known processes include high energy consumption, a relatively short average fibre length of the obtained stock, and mainly due to this, deficiencies in the tensile strength and tear resistance of the printing paper produced from the stock.

The above-mentioned problems can be reduced by the method of the present invention for producing stock, the stock itself, the use of the stock in producing printing paper and the printing paper itself. The method of producing stock in accordance with the present invention is characterised in that the stock is screened at a consistency of no less than 10%. The stock produced in accordance with the present invention is characterised in that at least 40% by weight of the fibres do not pass through a Bauer-McNett screen with a mesh size of 28. The printing paper produced in accordance with the present invention is characterised in that it has been made of stock that has been produced by the method in accordance with the present invention, or stock that has the same fibre distribution as the stock produced by the method of the present invention.

In the method of producing stock in accordance with the present invention, the stock is screened at a high consistency, whereby it is not necessary to change the consistency to suit each refining step between the refiner and the screen, but the refining and screening can be done at essentially the same consistency. The amount of energy that is consumed for pumping water into the process and pressing it out of the stock can thus be saved. When using the new screening method, there is no need for pumps to pump water, presses to remove water or a latency chest between the refining and screening steps of the process, whereby the process becomes simpler.

When using the new type of screen that screens stock at a high consistency, the quality of the stock improves because the screen efficiently separates the coarser fibres that need further refining into a reject fraction, and flexible, long fibres into an accept portion. In this way the printing paper produced from the long-fibre stock has good formation. The resin remains in the fines because, due to the high consistency, it cannot spread onto the surface of the fibres.

The screen is simple and does not contain moving parts and therefore its manufacture and maintenance costs are low. The size of the screen is small because the screening process is carried out at a high speed. Due to its small size, the manufacturing costs of the screen are low. The screen can utilise the steam produced in the refiner as the screening force, as a result of which no separate sources of power are necessarily required.

In addition, thanks to the new refining process, the energy consumption is lower than in the known methods which aim at the same freeness value. In this patent application, freeness refers to Canadian Standard Freeness, the unit of which is ml CSF. Freeness can be used to indicate the refining degree of the stock. According to the literature, the following correlation exists between the freeness and the total specific area of the fibre:

$$A=-3.03\ \ln(CSF)+21.3$$

where

A=the total specific area of the stock (unit $m^2/g$)

According to the formula mentioned above, the total specific area of the stock increases as the freeness decreases, that is, the freeness gives a clear indication of the refining degree because, as the proportion of fines grows, the specific area of the fibres increases.

In accordance with the present invention, the process produces mechanical stock in which the proportional amount of long fibres is high. The term mechanical stock is used in this application to indicate stock produced by refining wood raw material, such as chips. In connection with the refining, the wood raw material and/or stock is heat-treated in order to soften the wood raw material, in which case the process is that of producing thermomechanical pulp. The wood raw material may have also been treated with chemicals before being refined, in which case the process is that of producing chemi-thermomechanical pulp.

Because the average fibre length of stock produced in accordance with the new method is longer, the tensile strength and tear resistance of printing paper produced from this stock consisting of primary fibres are also improved. The proportion of long fibres in the stock is higher than in stocks produced by the known methods, such as the stock described above as the product of the process closest to,the state of the art. In the new method, the proportion of short fibres remains more or less the same as in the known methods, but the proportion of fibres of medium length decreases in the stock produced by the new method.

The stock can be used to manufacture printing paper, for example, newsprint, the grammage of which can be lower than that currently used in newsprint, while the properties of the paper still remain good. The stock can be used to manufacture newsprint, the grammage of which can be 30–40 g/m2, measured at a temperature of 23° C. and at a relative humidity of 50%.

Because paper with good strength properties can be obtained as the end product when utilising the manufacturing method presented by this invention, more fillers can be used to replace fibre than at present. For supercalendered paper, the filler content to be used can be approximately 30%, and for newsprint 7–15%, advantageously approximately 10%. It is noteworthy that the stock can be used to manufacture printing paper, the grammage of which can be lower than that of the printing paper normally used at present, and at the same time the filler content can be increased, even though fillers reduce the strength of the paper. Fillers are cheaper than fibre raw material and improve the light scattering coefficient and opacity of the paper.

The tree species that have been presented in this application as suitable raw materials are spruce (*Picea abies*), pine (*Pinus sylvestris*) and southern pine (genus *Pinus*, several different species). It is also feasible that the stock made of wood raw material may contain stock obtained from at least two different tree species and/or stock prepared in at least two different ways, which at a suitable phase of preparation are mixed with each other. For example in supercalendered paper and in low-grammage coated papers, chemical pulp obtained by chemical cooking is generally one of the raw materials used, whereas it is not used in newsprint. The amount of chemical pulp in supercalendered paper is usually 10–20%, and in low-grammage coated papers 20–50% of the pulp composition. The pulp composition refers to the total fibre stock used for the manufacture of paper.

The properties required for newsprint grade, which is one important use of the stock presented in this patent application, are runnability, printability and appearance. What is meant by good runnability is that the paper can be conveyed through a printing machine without breaks in the web. Paper properties affecting the runnability of paper include tear resistance, formation, tensile strength, elongation and variation in grammage.

Printability means the ability of the paper to receive the print and to retain it. Printing ink must not come off when rubbed, transfer from one sheet to another or show through the paper. Paper properties affecting the printability of paper include, for example, smoothness, absorbency, moisture content, formation, opacity, brightness, porosity and pore size distribution.

The appearance of the paper can be judged by its optical properties, such as brightness, whiteness, purity and opacity.

The basic idea of the stock preparation method presented in this invention is to use a simple and energy saving process to manufacture stock in which there is a high relative proportion of long fibres. The average fibre length obtained by utilising the method is approximately 10% longer than in the prior art method. At the first stage of refining the wood raw material is refined at a high temperature, advantageously at a temperature of 165–175° C., and at a superatmospheric pressure of over 400 kPa, advantageously at a superatmospheric pressure of 600–700 kpa, for only a very short time, as a result of which the stock remains quite coarse after the first stage of refining. What is meant by superatmospheric pressure is the pressure in comparison with normal atmospheric pressure. The average retention time of the raw material to be fed in the high pressure refiner is only 5–10 seconds. The temperature at which refining takes place is determined by the pressure of the saturated vapour.

After the first stage of refining, the stock is screened so as to produce a first accept stock portion and a first reject stock portion. When the stock has been screened into a first accept stock portion and a first reject stock portion, there are different possible procedures for continuing the process, such as 1-step processing of the first reject stock portion, in which the reject stock portion is refined and screened in one step. Accept stock portions are taken out of the process after each stage of screening and/or accept stock portions are re-screened, or 2-step processing of the first reject stock portion, in which the reject stock portion is refined and screened in two steps. The accept stock portions are taken out of the process after each stage of screening and/or accept stock portions are re-screened, or 3-step processing of the first reject stock portion, in which the reject stock is refined and screened in three steps and the accept stock portions are taken out of the process after each screening stage, or forward-connected 2- or 3-step processing of reject stock, which means the processing of the reject stock first in two or three steps and the removal of the accept stocks after each screening stage, and thereafter the refining of the last reject stock portion, for example, in a low-consistency refiner and removal from the process of the whole stock processed in the low-consistency refiner.

In the above-mentioned alternatives, one step consists of a successive refiner and screen. Further on, the above-mentioned embodiments are described in detail. The accept stock portions obtained at different stages of the process are combined and mixed, possibly bleached, and utilised as a raw material for making paper in a paper machine. The machinery for preparing the stock may consist of several parallel processing lines, from which all the obtained accept stock portions are combined.

The first stage of refining, the so-called primary refining, is advantageously conducted in a one-stage process. There may, however, be several parallel refiners at the same stage. A refiner may be a conical or a disc refiner, advantageously a conical refiner. A conical refiner produces longer pulp fibres than a disc refiner. After the first stage of refining, the pulp is screened into a first accept stock portion and a first reject stock portion. Screening is conducted at a high consistency, of not less than 10%. More advantageously, screening is conducted at a consistency of not less than 20%, and most advantageously at a consistency of not less than 40%. However, the consistency of the material being screened may not be more than 90%, more advantageously not more than 80% and most advantageously not more than 60%.

The stock is fed into a refiner either by means of a separate power source, for example, compressed air, or by utilising the outlet pressure of a refiner, which pressure at the first stage of refining is over 400 kPa, advantageously 600–700 kPa, and at the subsequent stages after the first stage of refining, either over 400 kPa, advantageously 600–700 kPa, or not more than 400 kPa, advantageously 300–400 kPa. The stock leaving the refiner is a mixture of steam and fibres with a consistency of 40–60%. The water is in the form of steam.

The process results in a stock with a freeness value of 30–70 ml CSF. Stock of this kind is suitable for making printing papers, and because the stock also contains very long fibres, the paper will possess good strength properties. The paper will also have good printing properties.

The fibre distribution of a ready-made stock measured according to the Bauer McNett characterisation is as follows:

40–50% of the fibres do not pass through screens of 16 mesh and 28 mesh,

15–20% of the fibres pass through screens of 16 mesh and 28 mesh, but do not pass through screens of 48 mesh and 200 mesh, and 35–40% of the fibres pass through screens of 48 mesh and 200 mesh, in other words these fibres pass through all the screens used (−200 mesh).

The average fibre length of fibres retained on a screen of 16 mesh is 2.75 mm, the average fibre length of fibres retained on a screen of 28 mesh is 2.0 mm, the average fibre length of fibres retained on a screen of 48 mesh is 1.23 mm and the average fibre length of fibres retained on a screen of 200 mesh is 0.3 mm. (J. Tasman: The Fibre Length of Bauer-McNett Screen Fractions, TAPPI, Vol.55, No.1 (January 1972))

The stock thus obtained contains 40–50% of fibres with an average fibre length of over 2.0 mm, 15–20% of fibres with an average fibre length of over 0.35 mm, and 35–40% of fibres with an average length of less than 0.35 mm.

In the following, the invention is described in more detail with reference to FIGS. 1–6.

Figure 4:
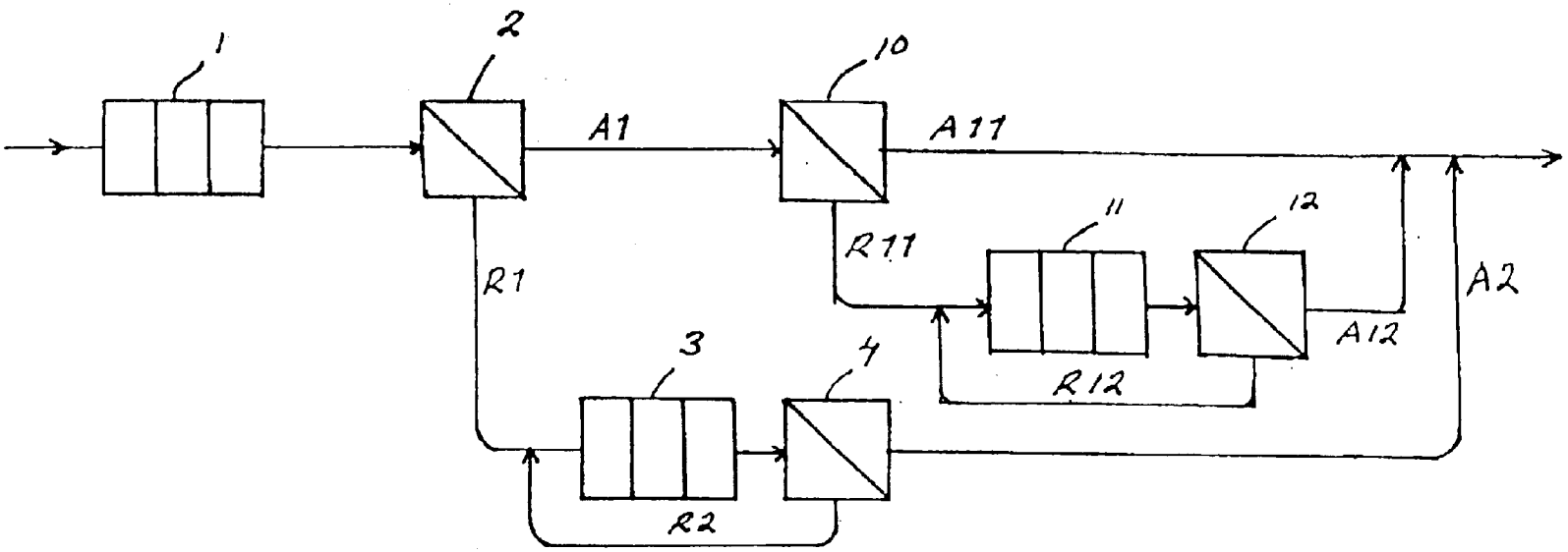
Figure 5:
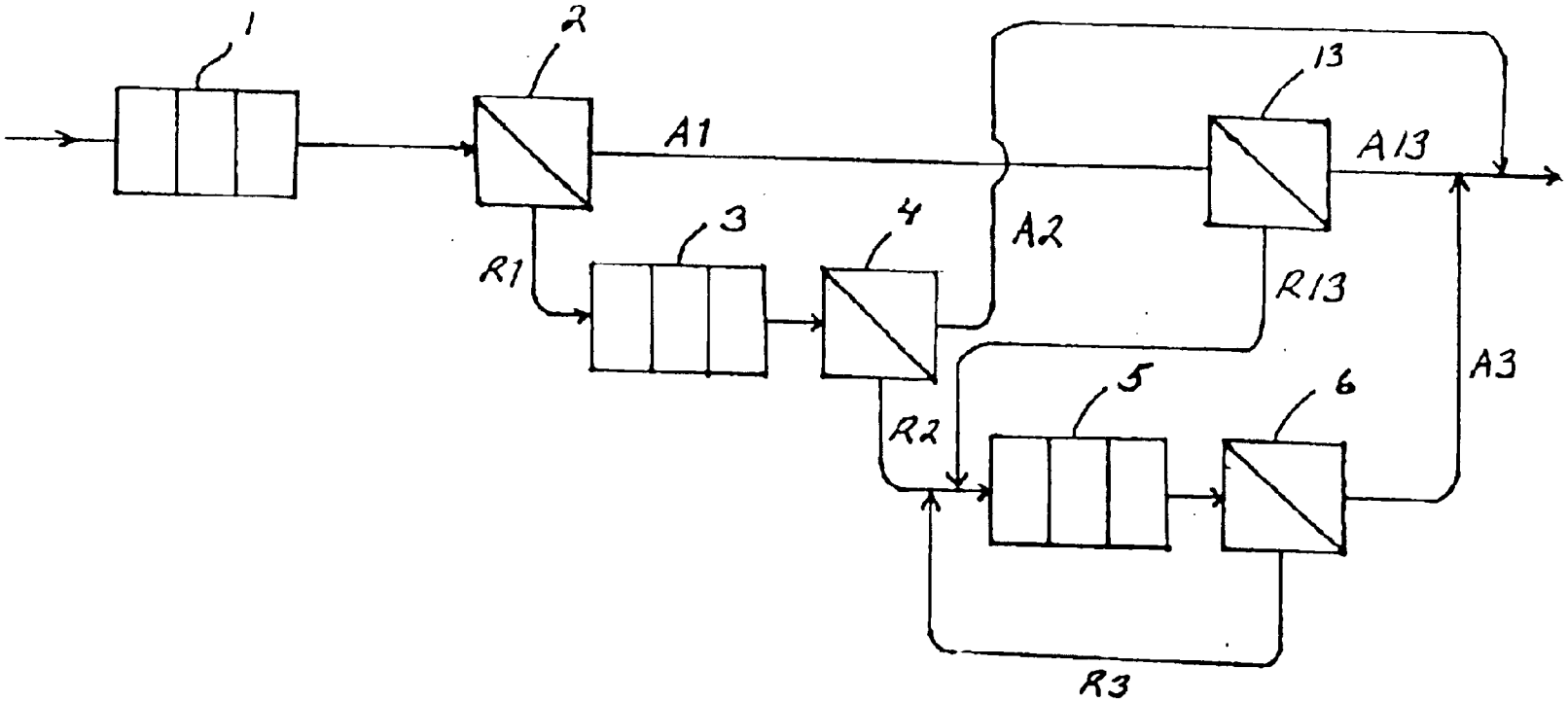
Figures 6A, 6B:
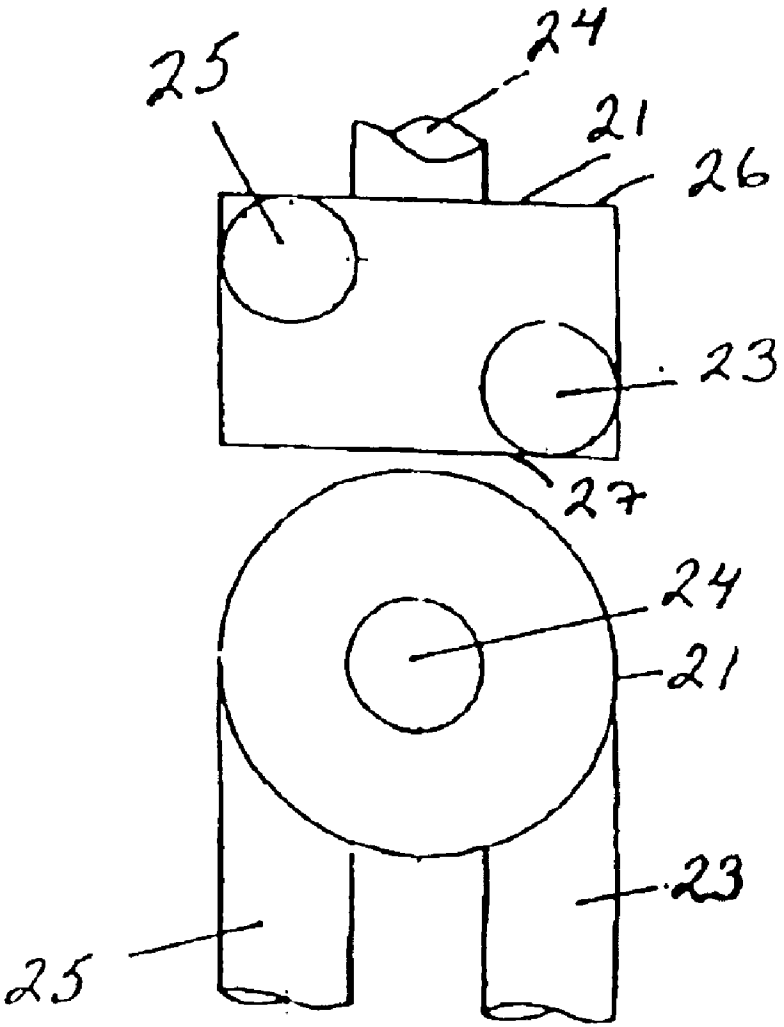

FIGS. 1–5 show schematic diagrams for the stock preparation process, all of which are different embodiments of the same invention, and FIG. 6 shows a possible structure of a screen, where FIG. 6*a* shows the screen from the side and FIG. 6*b* shows the screen seen from above.

Before feeding the chips into the process according to FIG. 1, the chips are pre-processed in hot steam under pressure, whereby the chips are softened. The pressure used in the pre-processing is advantageously 50–800 kPa. Chemicals e.g. alkaline peroxide or sulphites, such as sodium sulphite, can also be used in the pre-processing of the chips. Means for separating the steam, such as cyclones, are usually also used in the process before the refiners.

In the process according to FIG. 1, the chips are conveyed at a consistency of 40–60%, e.g. at a consistency of about 50%, to refiner 1, which produces stock with a freeness value of 250–700 ml CSF. When spruce (*Picea abies*) is used as the raw material, the average fibre length after refiner 1 is at least 2.0 mm. The pressure in refiner 1 is high, a superatmospheric pressure of more than 400 kPa, advantageously 600–700 kPa. The refiner can be a conical or a disc refiner, advantageously a conical refiner. The stock obtained from a conical refiner has a longer fibre length than that from a disc refiner. The energy consumption with refiner 1 is 0.3–1.1 MWh/t when the chips have not been processed with chemicals.

The stock is fed to screen 2 at essentially the same consistency as to refiner 1, i.e. a consistency of 40–60%, advantageously at about 50%.

Screen 2 gives the first accept stock portion A1 with a freeness value of 20–50 ml CSF. The first reject stock portion R1 constitutes 60–90%, advantageously about 80%, of the total stock. The first reject stock portion R1 is fed at a consistency of 30–40%, advantageously at a consistency of about 50%, to refiner 3 and from there onwards at essentially the same consistency to screen 4. The energy consumption of refiner 3 is 0.4–1.7 MWh/t.

From screen 4 are obtained the second accept stock portion A2 and the second reject stock portion R2, which comprises 60–80% of the first reject stock portion R1 rejected by screen 4 at the previous stage. The second reject stock portion R2 is fed, at a consistency of 30–60%, advantageously at a consistency of 50%, to refiner 5 and from there onwards at essentially the same consistency to screen 6, from which are obtained the third accept stock portion A3 and the third reject stock portion R3, which is returned to be fed into refiner 5. The energy consumption of the refiner is 0.4–1.7 MWh/t. The total stock, which is obtained by combining the accept stock portions A1, A2 and A3, has a freeness value of 30–70 ml CSF.

At refiners 3 and 5 the pressure can be high, at least over 400 kPa, advantageously 600–700 kPa, or it can be at a normal level, not more than 400 kPa, advantageously 300–400 kPa.

The finished stock, which has been obtained by combining and mixing the accept stock portions A1, A2 and A3, has a fibre distribution, measured by the Bauer-McNett method, as follows:

40–50% of the fibres do not pass through screens of 16 and 28 mesh,

15–20% of the fibres pass through screens of 16 and 28 mesh, but do not pass through screens of 48 and 200 mesh, and 35–40% of the fibres pass through screens of 48 and 200 mesh.

Figure 2:
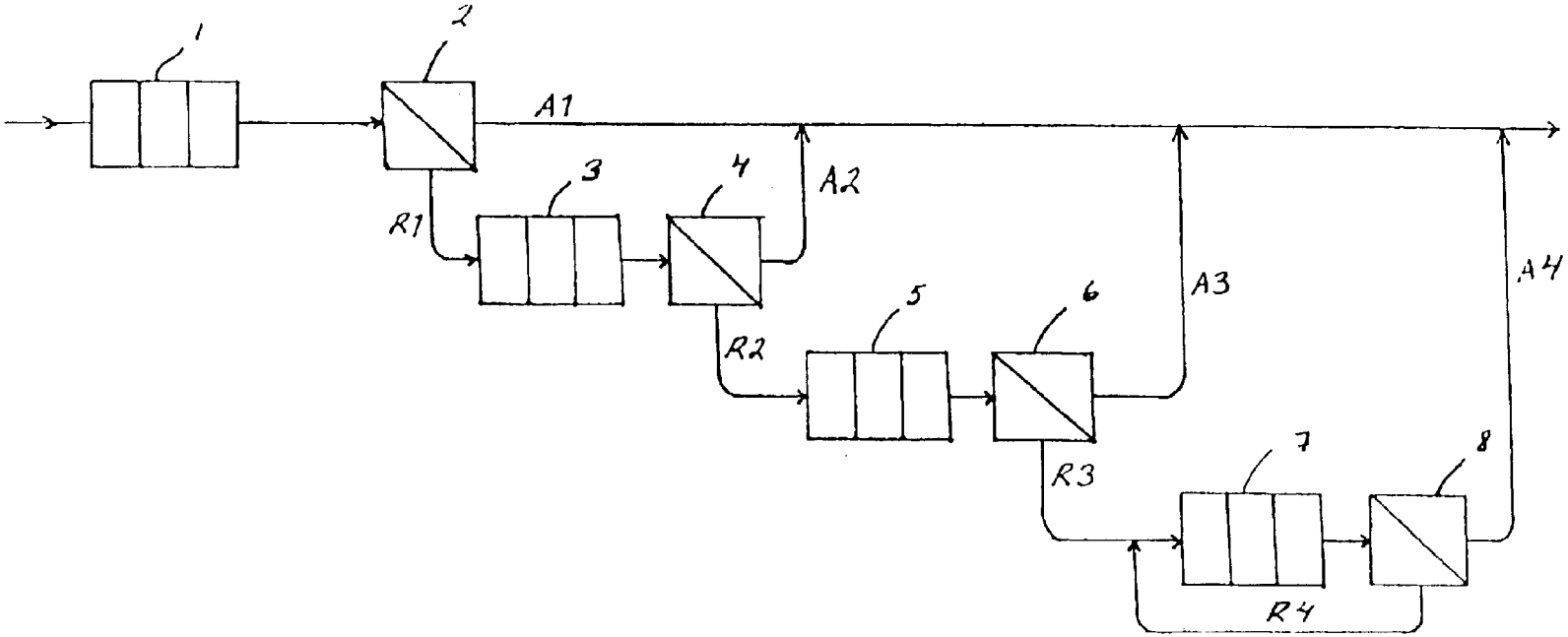

FIG. 2 shows an embodiment of the invention. The initial stage of the process is like the process shown in FIG. 1, but the third reject stock portion R3 is, instead, conveyed to refiner 7 and from there on to screen 8. The fourth accept stock portion A4, obtained from screen 8, is taken to be combined with the other accept stock portions A1, A2 and A3. The fourth reject stock portion R4 is returned to the inlet of refiner 7. This kind of procedure may be necessary when aiming at a low freeness level, e.g. a level of 30 ml CSF.

Figure 3:
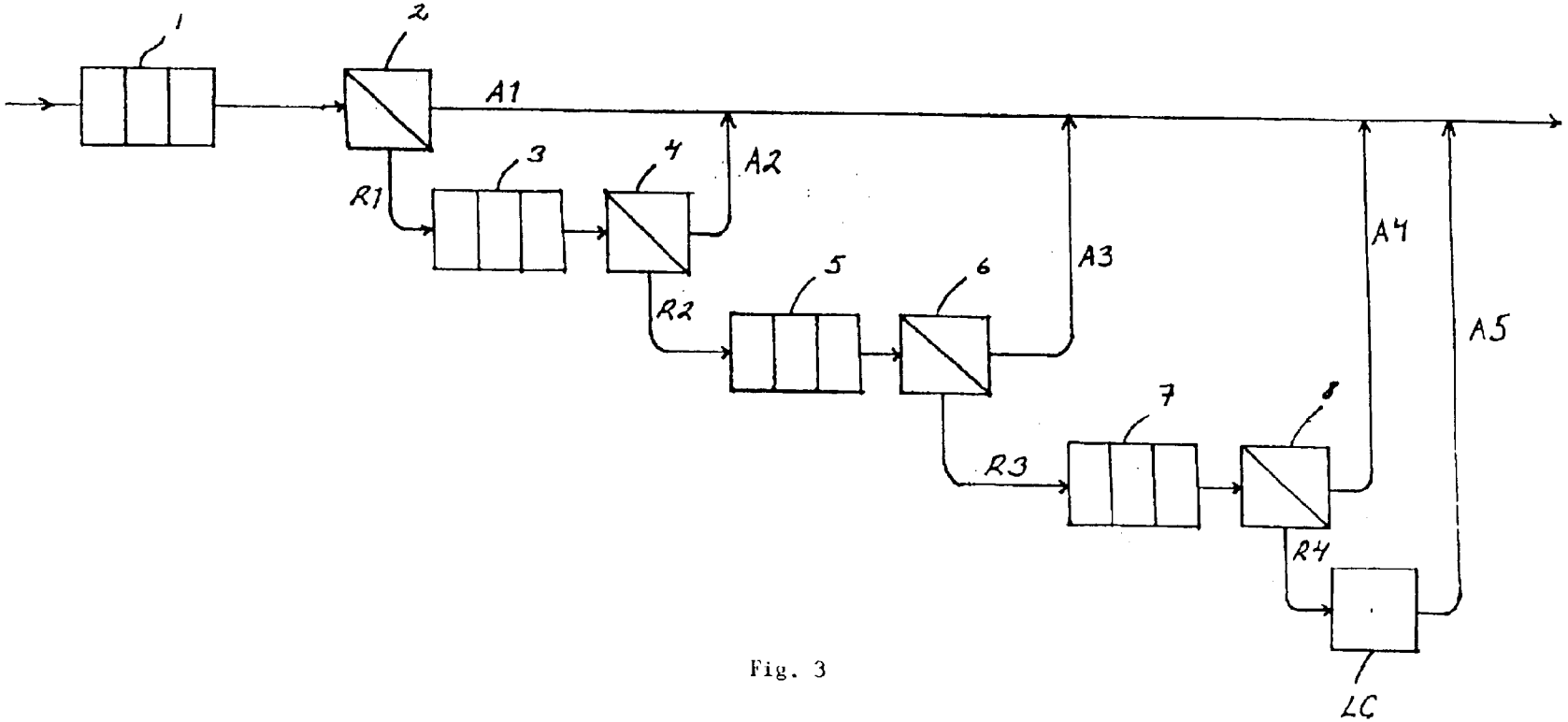

FIG. 3 shows another embodiment of the invention. The initial stage of the process proceeds as in the process shown in FIG. 2, but the fourth reject stock portion R4 is conveyed to low-consistency-refiner LC. The consistency of the stock portion R4 fed into low-consistency-refiner LC is 3–5%. The accept stock portions A1, A2, A3, A4 and A5 obtained are combined and mixed to form a ready-made stock.

FIG. 4 shows a third embodiment of the invention. The first reject stock portion R1 obtained from screen 2, is conveyed to refiner 3 and from there onwards to screen 4. The reject stock portion obtained from screen 4 is conveyed back to the inlet of refiner 3. The accept stock portion A2 obtained from screen 4 is taken out of the process.

The accept stock portion A1, obtained from screen 2, is conveyed for rescreening to screen 10. The accept stock portion A11 obtained from screen 10, is taken out of the process. The reject stock portion R11 obtained from screen 10, is conveyed to refiner 11 and from there on to screen 12. The reject stock portion R12, obtained from screen 12; is conveyed back to the inlet of refiner 11. The accept stock portion A12 obtained from screen 12, is taken out of the process to be combined with the other accept stock portions A11 and A2.

FIG. 5 shows a fourth embodiment of the invention. The process is otherwise the same as that shown in FIG. 1, but the accept stock portion A1 obtained from screen 2 is conveyed for re-screening to screen 13. The accept stock portion A13 obtained from screen 13, the accept stock portion A2 obtained from screen 4 and the accept stock portion A3 obtained from screen 6, are combined and mixed. The reject stock portion R13 obtained from screen 13 is combined with the reject stock portions R2 and R3, and the combined stock is conveyed to refiner 5.

In the above mentioned processes as shown in FIGS. 1–5, the wood raw material used can be any species of wood, but it is usually softwood, advantageously spruce, but e.g. pine and southern pine are also suitable wood raw materials for the purpose. When the wood raw material used is spruce and the chips have not been pre-treated with chemicals, the total energy consumption of the process is approximately 2.5 MWh/t. In this case, a freeness value of 30–70 ml CSF is achieved for the stock. Using the process shown in FIG. 1, the energy consumption at the first stage of refining is 0.3–1.1 MWh/t, at the second stage of refining 0.4–1.7 MWh/t, and at the third stage of refining 0.4–1.7 MWh/t. The required amount of energy is higher when processing pine than when processing spruce, e.g. processing southern pine requires approximately 1 MWh/t more energy than spruce. Also, changes in the size of chips affect the energy consumption. The energy consumption rates mentioned above are calculated according to a chip screening test, where the average length of a chip was 21.4 mm and the average thickness 4.6 mm.

Stock prepared by the methods described above, as shown in FIGS. 1–5, is used as a raw material for printing papers. The proportion of long fibres in such stock is high, so that they are able to form a reinforcing mesh in the paper. In spite of this, the formation of the paper is good and therefore good printing properties can be achieved.

FIG. 6 shows a possible embodiment of a screen to be used in the process. The screen used in the process is a new type of screen that makes it possible to screen relatively long-fibre stock easily. The screen comprises a cylindrical chamber, where the ratio between its diameter and the length of the housing is in the range of 1–10. The diameter of the screen is thus the same as or greater than the length of the housing. By the length of the housing is meant the perpendicular distance between the cylindrical chamber's plate-like sidewalls 26 and 27. A typical diameter for the chamber is approximately 1 m and the length of the housing 0.2 meters. The screen may contain a means for improving the screening, such as a screen drum, but this is not necessary.

The stock is conveyed tangentially from the refiner through a feed pipe from an inlet point 23 to the chamber 21, where a swirling motion is imparted to the stock by the lowering of pressure. In the spirally rotating stream of stock, the stock moving in the middle reaches a higher speed than that of the stock moving near the outermost edges, whereby the accept-stock portion moves towards the centre of the screen, and the reject stock portion to the inner perimeter of the cylinder or close to it. Separating is done on the basis of the mass, size, and the surface area of the fibres. There are outlets in the screen for both the accept stock portion, and the reject stock portion. The accept stock portion is passed out through an outlet pipe from the centre of cylinder 24, and the reject stock portion is passed out through an outlet pipe from the perimeter of cylinder 25. The inlet and the outlet pipes may be installed in different positions lengthwise on the cylinder's housing, or there may be several inlet and outlet pipes. The screen can be placed so that the cylindrical part of the chamber stands either vertically or horizontally.

The speed of the mixture of fibre and steam leaving the refiner is increased to a suitable speed that will produce the desired screening result, advantageously to a speed of 20.0–800 m/s, by choosing an appropriate diameter for the inlet pipe, or by adding appropriate nozzles to the pipe to regulate the flow. At such a speed, the coarse particles drift to the screen cylinder's sides, and the flexible, pliable fibres to the centre.

Several screens can be placed in line, whereby the accept stock portion of the next stage is returned to the inlet of the previous stage. In this way the reject stock portion is carefully separated from the accept stock portion, and only the stock that in fact needs further refining, is conveyed to re-refining.

The invention is not limited as regards the wood raw material solely to the tree species mentioned, but other tree species can also be used, although, for example, the energy consumption of the process and the average fibre length obtained vary depending on the wood raw material. The stock can contain fibres from different tree species.

The method for producing stock as claimed in the invention is not solely limited to methods where the first stage of the refining is performed at a pressure of over 400 kPa, but it can also include methods where refining takes place at a lower pressure.

The method for preparing stock may vary after the first phase of refining. The stock can be used for producing various types of printing paper. The core idea of the invention is that the stock refined and screened by a certain new method, is suitable as a raw material for printing papers, and makes it possible to produce printing paper more cost-efficiently than before. The main point is that the stock is screened at a consistency of not less than 10%.

What is claimed is:

1. A method for producing thermomechanical and chemi-thermomechanical pulp effective for use as a raw material for printing paper, the method comprising:

refining wood raw material in a refiner to form a refined stock which has a consistency of at least 20% and not more than 90%; and screening the refined stock at a consistency which is about the same as it is as it came from refining in a plurality of stages into accept stock portions and reject stock portions to form a ready made stock having a freeness value of 30 to 70 ml CSF.

2. The method of claim 1, wherein the refined stock is screened at a consistency of 30 to 60%.

3. The method of claim 2, wherein the screening is carried out by a screen having a diameter to length of housing ratio of 1 to 10.

4. The method of claim 1, wherein wood raw material is refined at a superatmospheric pressure of over 400 kPa, and at a superatmospheric pressure of 600 to 700 kpa.

5. The method of claim 4, wherein the freeness value of the refined stock is 250 to 700 ml CSF.

6. The method of claim 1, wherein after refining, the refined stock is screened into a first accept and a first reject stock portion.

7. The method of claim 6, wherein the freeness value of the first accept stock portion is 20 to 50 ml CSF.

8. The method of claim 6, wherein the first accept stock portion is taken out of the process.

9. The method of claim 6, wherein the first accept stock portion is conveyed to re-screening.

10. The method of claim 9, wherein the first accept stock portion is re-screened to form a secondary accept stock portion and a secondary reject stock portion.

11. The method of claim 10, wherein the secondary accept stock portion is taken out of the process.

12. The method of claim 10, wherein the secondary reject stock portion is conveyed to refining, after which it is screened to form a third accept stock portion and a third reject stock portion.

13. The method of claim 12, wherein the third accept stock portion is taken out of the process.

14. The method of claim 13, wherein the third reject portion is conveyed back to refining.

15. The method of claim 9, wherein the first accept stock portion is screened to produce a fourth accept stock portion and a fourth reject stock portion.

16. The method of claim 15, wherein the fourth accept stock portion is taken out of the process.

17. The method of claim 15, wherein the fourth reject stock portion is conveyed to a third refining stage.

18. The method of claim 6, wherein the first reject stock portion comprises 60 to 90% by weight of the refined stock.

19. The method of claim 6, wherein the first reject stock portion is fed into a second refining stage, and stock obtained from said second refining stage is screened to produce a second accept stock portion and a second reject stock portion.

20. The method of claim 19, wherein the second reject stock portion comprises between 60 and 80% by weight of the stock in the second screening.

21. The method of claim 20, wherein the second reject stock portion is taken to a third refining stage to produce a third refined stock and the stock obtained from said third refining stage is screened so as to form a fifth accept stock potion and a fifth reject stock portion.

22. The method of claim 21, wherein the fifth accept stock portion is taken out of the process.

23. The method of claim 22, wherein the secondary accept stock portion, third accept stock portion and fifth accept stock portion are combined and mixed to form a ready-made stock.

24. The method of claim 22, wherein the first accept stock portion, second accept stock portion and fifth stock portion are combined and mixed to form a ready-made stock.

25. The method of claim 22, wherein the second accept stock, fourth accept stock and fifth accept stock are combined and mixed to form a ready-made stock.

26. The method of claim 21, wherein the fifth reject stock portion is conveyed back to the third phase of refining.

27. The method of claim 21, wherein the fifth reject stock portion is conveyed to a fourth phase of refining, and the stock from said fourth stage of refining is screened to form a sixth accept stock and sixth reject stock.

28. The method of claim 27, wherein the sixth accept stock is taken out of the process.

29. The method of claim 28, wherein the first accept stock portion, second accept stock portion, fifth accept stock portion and sixth accept stock portion are combined and mixed to form a ready-made stock.

30. The method of claim 27, wherein the sixth reject stock is conveyed back into the fourth phase of refining.

31. The method of claim 27, wherein the sixth rejected stock portion is conveyed to a low consistency refiner.

32. The method of claim 31, wherein a seventh accept stock portion refined in the low consistency refiner, is taken out of the process.

33. The method of claim 32, wherein the first accept stock portion, second stock portion, fifth accept stock portion, sixth accept stock portion and seventh accept stock portion are combined and mixed to form a ready-made stock.

34. The method of claim 19, wherein the second reject stock portion is conveyed back into the second refining stage.

35. The method of claim 19, wherein the second accept stock portion is taken cut of the process.

36. A method for producing thermomechanical and chemi-thermomechanical pulp effective for use as a raw material for printing papers the method comprising:

refining wood raw material in a refiner to form a refined stock; and screening the refined stock in a plurality of stages into accept stock portions and reject stock portions to form a ready made stock having a freeness value of 30 to 70 ml CSF, wherein the stock is screened at a consistency of at least 20% and not more than 90%, the method effective for providing a stock with 40 to 50% of the fibers having an average fiber length of greater than 2.0 mm.

37. A method for producing thermomechanical and chemi-thermomechanical pulp effective for use as a raw material for printing paper, the method comprising:

refining wood raw material in a refiner at a superatmospheric pressure of over 400 kPa at from 165° C. to 175° C. to form a refined stock which has a consistency of from 40% to 90%; and screening the refined stock at a consistency at about the same as it came from refining in a plurality of stages into accept stock portions and reject stock portions to form a ready made stock having a freeness value of 30 to 70 ml CSF, wherein the stock is screened at a consistency of at least 20% and not more than 90%, the method effective for providing a stock with 40 to 50% of the fibers having an average fiber length of greater than 2.0 mm.

38. The method as recited in claim 37, wherein the pressure, temperature and average time of each of the refining steps are effective to provide the ready made stock with 40 to 50% of the fibers do not pass through screens of 16 and 28 mesh and 35–40% of the fibers pass through screens of 48 and 200 mesh.

39. A method for producing thermomechanical and chemi-thermomechanical pulp effective for use as a raw material for printing paper, the method comprising;

refining wood raw material in a refiner to form a refined stock; and screening the refined stock in a plurality of stages into accept stock portions and reject stack portions to form a ready made stock having a freeness value of 30 to 70 ml CSF, wherein the stock is screened at a consistency of at least 20% and not more than 90% and the refining and screening are done at the same consistency in more than one of the plurality of stages, the method effective for providing a stock with 40 to 50% of the fibers having an average fiber length of greater than 2.0 mm.

* * * * *

UNITED STATES PATENT AND TRADEMARK OFFICE

CERTIFICATE OF CORRECTION

PATENT NO. : 6,818,099 B2
APPLICATION NO. : 10/165191
DATED : November 16, 2004
INVENTOR(S) : Taisto Tienvieri et al.

It is certified that error appears in the above-identified patent and that said Letters Patent is hereby corrected as shown below:

Column 10, line 48, delete “cut” and insert --out-- therefor.

Column 10, line 51, delete “papers” and insert --paper,-- therefor.

Column 12, line 3, after “comprising” delete “ ; ” and insert -- : --.

Column 12, line 6, delete “stack” and insert --stock-- therefor.

Signed and Sealed this

Twenty-fourth Day of July, 2007

JON W. DUDAS
*Director of the United States Patent and Trademark Office*